US010885846B2

(12) United States Patent
Xuan et al.

(10) Patent No.: US 10,885,846 B2
(45) Date of Patent: Jan. 5, 2021

(54) PIXEL DRIVING CIRCUIT, DISPLAY DEVICE AND DRIVING METHOD

(71) Applicant: BOE TECHNOLOGY GROUP CO., LTD., Beijing (CN)

(72) Inventors: Minghua Xuan, Beijing (CN); Shengji Yang, Beijing (CN); Pengcheng Lu, Beijing (CN); Jie Fu, Beijing (CN); Lei Wang, Beijing (CN); Li Xiao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 261 days.

(21) Appl. No.: 16/096,035

(22) PCT Filed: Apr. 23, 2018

(86) PCT No.: PCT/CN2018/084063

§ 371 (c)(1),
(2) Date: Oct. 24, 2018

(87) PCT Pub. No.: WO2018/210103

PCT Pub. Date: Nov. 22, 2018

(65) Prior Publication Data

US 2020/0342811 A1 Oct. 29, 2020

(30) Foreign Application Priority Data

May 19, 2017 (CN) ..... 2017 1 0357915

(51) Int. Cl.
*G09G 3/3258* (2016.01)

(52) U.S. Cl.
CPC ... *G09G 3/3258* (2013.01); *G09G 2300/0842* (2013.01); *G09G 2310/0286* (2013.01)

(58) Field of Classification Search
None
See application file for complete search history.

(56) References Cited

U.S. PATENT DOCUMENTS

2006/0197554 A1* 9/2006 Jinta ..... G11C 19/184 326/81
2011/0273416 A1* 11/2011 Bae ..... H02M 3/07 345/211
2014/0055444 A1* 2/2014 Jang ..... G09G 3/3291 345/213
2014/0092078 A1* 4/2014 Yoon ..... G09G 3/3696 345/212

(Continued)

*Primary Examiner* — Ibrahim A Khan
(74) *Attorney, Agent, or Firm* — Myers Bigel, P.A.

(57) ABSTRACT

The present disclosure relates to a pixel driving circuit, a display device and a driving method. The pixel driving circuit is configured to control on and off of a pixel unit, and includes: a first control sub-circuit, a first output sub-circuit, a second control sub-circuit, a second output sub-circuit, a third control sub-circuit, and a fourth control sub-circuit. Specifically, the fourth control sub-circuit is configured, if turned on, to cause a voltage drop of the first level signal input at the first level signal input terminal and to output the first level signal with the voltage drop to the third control node, such that a voltage at the third control node is less than or equal to a voltage at the first control node, thereby maintaining the third control sub-circuit off.

19 Claims, 7 Drawing Sheets

(56) References Cited

U.S. PATENT DOCUMENTS

| | | | | |
|---|---|---|---|---|
| 2015/0015562 | A1* | 1/2015 | Han | G11C 19/28 345/212 |
| 2015/0179277 | A1* | 6/2015 | Pai | G09G 3/20 377/68 |
| 2015/0317954 | A1* | 11/2015 | Jang | G11C 19/28 345/213 |
| 2015/0356909 | A1* | 12/2015 | Lim | G09G 3/3677 345/205 |
| 2016/0019976 | A1* | 1/2016 | Pai | G09G 3/3266 345/204 |
| 2016/0351160 | A1* | 12/2016 | In | G09G 3/3225 |
| 2017/0032733 | A1* | 2/2017 | Jang | H01L 29/78633 |
| 2017/0301295 | A1* | 10/2017 | Park | G09G 3/3258 |
| 2018/0137808 | A1* | 5/2018 | Na | G09G 3/3233 |
| 2019/0139486 | A1* | 5/2019 | Li | G09G 3/3677 |

* cited by examiner

PIXEL DRIVING CIRCUIT, DISPLAY DEVICE AND DRIVING METHOD

CROSS REFERENCE TO RELATED APPLICATIONS

The present application is a 35 U.S.C. 371 national stage application of PCT International Application No. PCT/CN2018/084063, filed on Apr. 23, 2018, which claims the benefit of Chinese patent application No. 201710357915.1, filed on May 19, 2017, the contents of which are incorporated herein by reference in their entireties.

TECHNICAL FIELD

The present disclosure relates to the technical field of pixel driving circuits, and in particular to a pixel driving circuit, a display device and a driving method.

BACKGROUND

In an active-matrix organic light emitting diode (AMOLED) display device, the driving circuit includes a gate driving circuit, a reset driving circuit, and a pixel driving circuit, in addition to an OLED organic light emitting device. Specifically, the gate driving circuit and the reset driving circuit are shift registers that supply voltages during a light-emitting preparation stage in which no light is emitted. The pixel driving circuit is a shift register for controlling the duration and/or timing of light emission.

SUMMARY

According to an aspect of the present disclosure, there is provided a pixel driving circuit configured to control on and off of a pixel unit. Specifically, the pixel driving circuit includes: a first control sub-circuit, a first output sub-circuit, a second control sub-circuit, a second output sub-circuit, a third control sub-circuit, and a fourth control sub-circuit. The first control sub-circuit is connected to the first output sub-circuit and the third control sub-circuit respectively through a first control node, the first output sub-circuit is further connected to a first level signal input terminal and a pixel unit signal output node respectively, and the pixel unit signal output node is configured to control on and off of the pixel unit. The second control sub-circuit is connected to the third control sub-circuit and the second output sub-circuit respectively through a second control node, and the second output sub-circuit is further connected to a second level signal input terminal and the pixel unit signal output node respectively. The third control sub-circuit is further connected to the fourth control sub-circuit through a third control node, and the fourth control sub-circuit is further connected to the first level signal input terminal and a first clock signal input terminal respectively. The fourth control sub-circuit is configured, if turned on, to cause a voltage drop of a first level signal input at the first level signal input terminal and to output the first level signal with the voltage drop to the third control node, such that a voltage at the third control node is less than or equal to a voltage at the first control node, thereby maintaining the third control sub-circuit off.

Further, according to an embodiment of the present disclosure, in the pixel driving circuit, the third control sub-circuit includes a first transistor. A gate of the first transistor is connected to the first control node, a source of the first transistor is connected to the third control node, and a drain of the first transistor is connected to the second control node. The fourth control sub-circuit includes a second transistor. A gate of the second transistor is connected to the first clock signal input terminal, a source of the second transistor is connected to the first level signal input terminal, and a drain of the second transistor is connected to the third control node.

Further, according to an embodiment of the present disclosure, the pixel driving circuit further includes a first capacitor. Specifically, one plate of the first capacitor is connected to the second control node, and the other plate of the first capacitor is connected to the first level signal input terminal.

Further, according to an embodiment of the present disclosure, in the pixel driving circuit, the first output sub-circuit includes a third transistor. A gate of the third transistor is connected to the first control node, a source of the third transistor is connected to the first level signal input terminal, and a drain of the third transistor is connected to the pixel unit signal output node. The second output sub-circuit includes a fourth transistor. A gate of the fourth transistor is connected to the second control node, a source of the fourth transistor is connected to the second level signal input terminal, and a drain of the fourth transistor is connected to the pixel unit signal output node. A width-to-length ratio of the third transistor is larger than that of the fourth transistor.

Further, according to an embodiment of the present disclosure, in the pixel driving circuit, the first control sub-circuit includes: a fifth transistor, a sixth transistor, a seventh transistor, an eighth transistor, a ninth transistor, a tenth transistor, and an eleventh transistor. A gate of the fifth transistor is connected to the second node, a source of the fifth transistor is connected to the first clock signal input terminal, and a drain of the fifth transistor is connected to the first node, for outputting a first clock signal input at the first clock signal input terminal to the first node when a signal at the second node is an on signal. A gate of the sixth transistor is connected to the first clock signal input terminal, a source of the sixth transistor is connected to the second level signal input terminal, and a drain of the sixth transistor is connected to the first node, for outputting a second level signal input at the second level signal input terminal to the first node when the first clock signal input at the first clock signal input terminal is an on signal. A gate of the seventh transistor is connected to the first node, a source of the seventh transistor is connected to the first level signal input terminal, and a drain of the seventh transistor is connected to the first control node, for outputting the first level signal input at the first level signal input terminal to the first control node when a signal at the first node is an on signal. A gate of the eighth transistor is connected to the first clock signal input terminal, a source of the eighth transistor is connected to an initial signal input terminal, and a drain of the eighth transistor is connected to the second node, for outputting an initial signal input at the initial signal input terminal to the second node when the first clock signal input at the first clock signal input terminal is an on signal. The second node is connected to the third node. A gate of the ninth transistor is connected to the third node, a source of the ninth transistor is connected to a second clock signal input terminal, and a drain of the ninth transistor is connected to the first control node, for outputting a second clock signal input at the second clock signal input terminal to the first control node when a signal at the third node is an on signal. A gate of the tenth transistor is connected to the first node, a source of the tenth transistor is connected to the first level signal input terminal, and a drain of the tenth transistor is connected to a fourth node, for outputting the first level signal input at the first level signal input terminal to the fourth node when a signal at the first node is an on signal. A gate of the eleventh transistor is connected to the second clock signal input terminal, a source of the eleventh transistor is connected to the fourth node, and a drain of the eleventh transistor is connected to the second node, for outputting a signal input at the fourth node to the second node when the second clock signal input at the second clock signal input terminal is an on signal.

Further, according to an embodiment of the present disclosure, in the pixel driving circuit, the first control sub-circuit further includes a twelfth transistor. A gate of the twelfth transistor is connected to the second level signal input terminal, a source of the twelfth transistor is connected to the second node, and a drain of the twelfth transistor is connected to the third node, for allowing conduction between the second node and the third node when a signal input at the second level signal input terminal is an on signal. Alternatively, according to other embodiments, in the pixel driving circuit, the first control sub-circuit further includes a twelfth transistor. A gate of the twelfth transistor is connected to the second level signal input terminal, a drain of the twelfth transistor is connected to the second node, and a source of the twelfth transistor is connected to the third node, for allowing conduction between the second node and the third node when the second level signal input at the second level signal input terminal is an on signal.

Further, according to an embodiment of the present disclosure, in the pixel driving circuit, the first control sub-circuit further includes a second capacitor and/or a third capacitor. Specifically, one plate of the second capacitor is connected to the first node, and the other plate of the second capacitor is connected to the first level signal input terminal. In addition, one plate of the third capacitor is connected to the first control node, and the other plate of the third capacitor is connected to the third node.

Further, according to an embodiment of the present disclosure, in the pixel driving circuit, the second control sub-circuit includes a thirteenth transistor. A gate of the thirteenth transistor is connected to the first clock signal input terminal, a source of the thirteenth transistor is connected to the second level signal input terminal, and a drain of the thirteenth transistor is connected to the second control node, for outputting the second level signal input at the second level signal input terminal to the second control node when the first clock signal input at the first clock signal input terminal is an on signal.

According to another aspect of the present disclosure, there is also provided a display device including the pixel driving circuit as described in any of the above embodiments.

According to yet another aspect of the present disclosure, there is also provided a driving method for driving on and off of a pixel unit using the pixel driving circuit as described in any of the above embodiments. Specifically, the driving method includes: during a light-emitting stage, driving the second output sub-circuit to be turned on, wherein the second output sub-circuit output the second level signal input at the second level signal input terminal to the pixel unit signal output node; driving the first control sub-circuit to output the first level signal to the first control node, thereby controlling the third control sub-circuit and the first output sub-circuit to be turned off; and driving the fourth control sub-circuit to be turned on, wherein the fourth control sub-circuit causes a voltage drop of a first level signal received from the first level signal input terminal, and outputs the first level signal with the voltage drop to the third control node, such that a voltage at the third control node is less than or equal to a voltage at the first control node, thereby maintaining the third control sub-circuit off.

BRIEF DESCRIPTION OF THE DRAWINGS

In order to illustrate the technical solutions in embodiments of the present disclosure more clearly, the appended drawings needed to be used in the description of embodiments will be introduced briefly in the following. Obviously, the drawings in the following description are only representative of some embodiments of the present disclosure, and for those of ordinary skills in the art, other drawings can be obtained according to these drawings under the premise of not paying out creative work.

DETAILED DESCRIPTION OF THE EMBODIMENTS

In the following, the technical solutions in embodiments of the present disclosure will be described clearly and completely in connection with the drawings in the embodiments of the present disclosure. Obviously, the described embodiments are only part of the embodiments of the present disclosure, and not all of the present embodiments. Based on the present embodiments described in the present disclosure, all other embodiments obtained by those of ordinary skills in the art under the premise of not paying out creative work pertain to the protection scope of the present disclosure.

Figure 1:
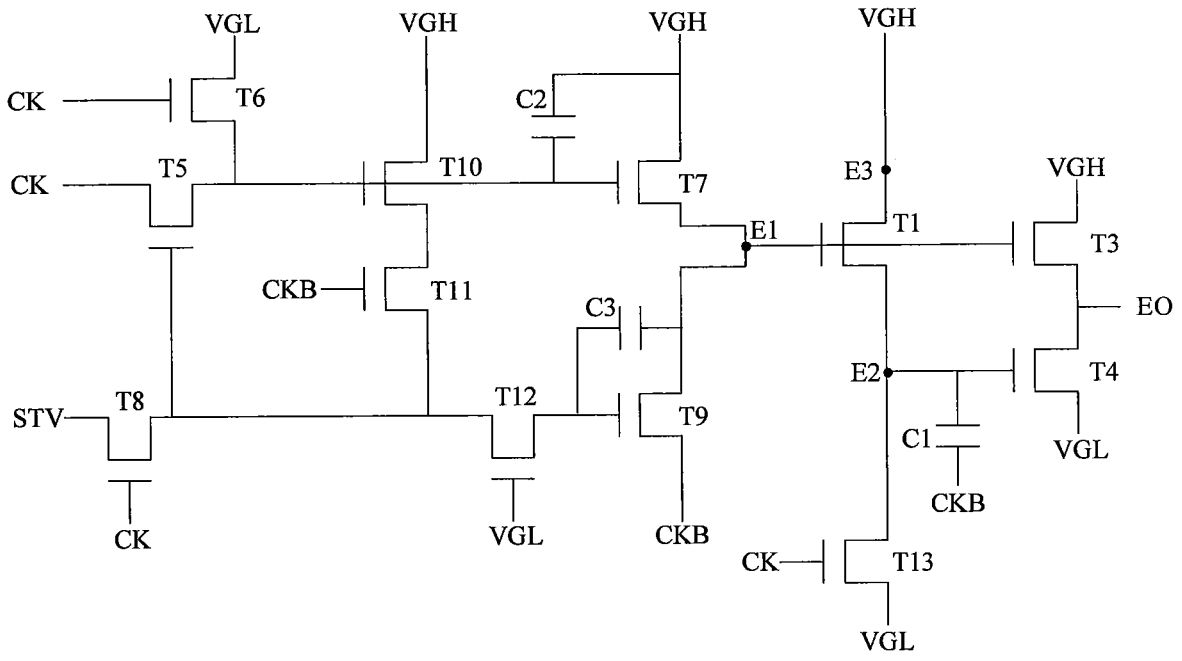
FIG. 1 is a circuit structure diagram of a pixel driving circuit according to a related art.

Referring to FIG. 1, a circuit structure diagram of a pixel driving circuit according to a related art is shown. Specifically, as shown in FIG. 1, the pixel driving circuit may include a first transistor T1, a third transistor T3 to a thirteenth transistor T13, and a first capacitor C1 to a third capacitor C3. The pixel driving circuit realizes pixel driving by connecting a first clock signal input terminal CK, a second clock signal input terminal CKB, a first level signal input terminal VGH, a second level signal input terminal VGL, and an initial signal input terminal STV. However, for this pixel driving circuit, a voltage at a pixel unit signal output node EO is unstable during the light-emitting stage, which is easy to cause multi-line output of a pixel unit and problems such as display abnormality.

Figure 2:
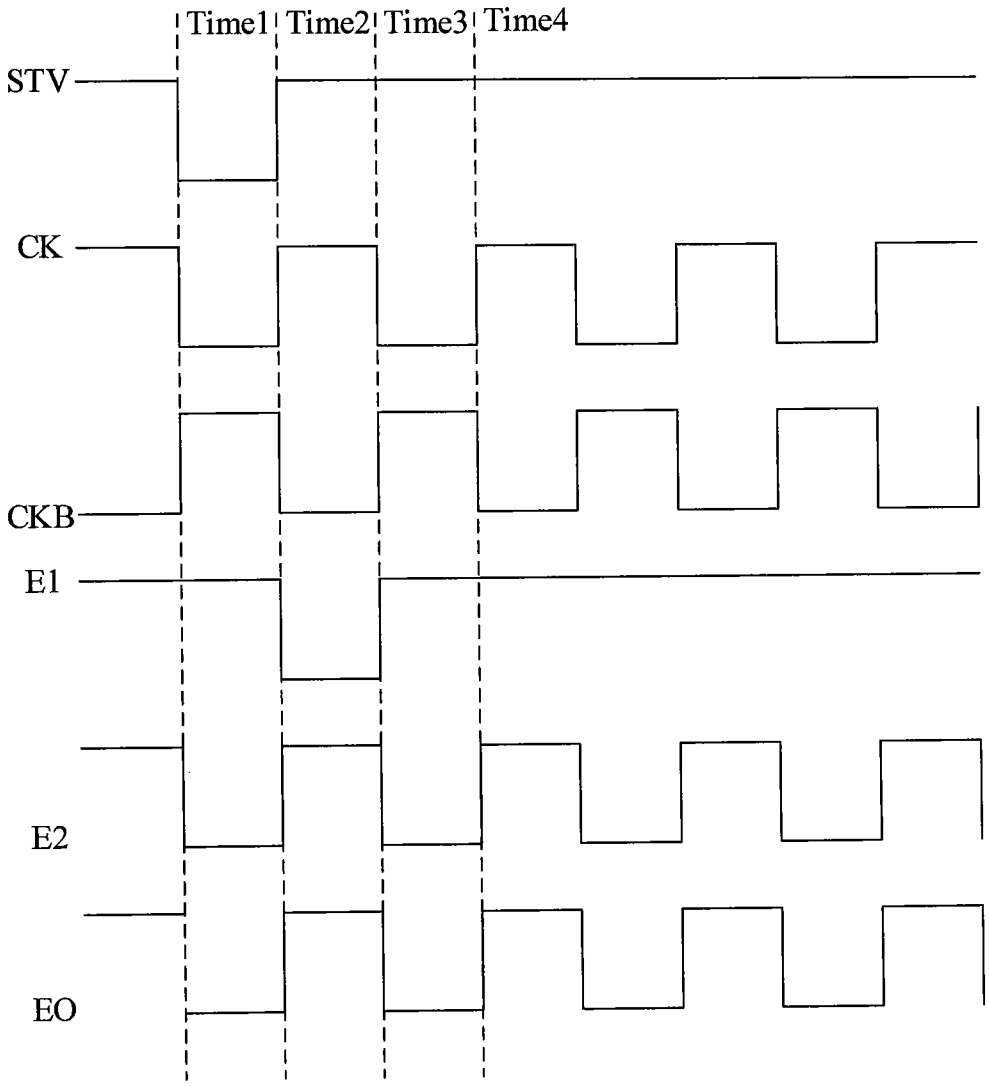
FIG. 2 is a timing diagram of operation of the pixel driving circuit shown in FIG. 1.

Based on the circuit structure of the pixel driving circuit as shown in FIG. 1, the inventors have found that the first transistor T1 is directly connected to the first level signal input terminal VGH. Thus, during the light-emitting stage, when a first level signal is input at the first level signal input terminal VGH, the seventh transistor T7 outputs the first level signal to a first control node E1. Furthermore, the first level signal is also input to a third control node E3. In such a case, since a voltage at the first control node E1 and a voltage at the third control node E3 are equal, the first transistor T1 is allowed to satisfy the following relationship: $V_{gs}=0$. Of course, since the seventh transistor T7 has a certain resistance in actual operations, the voltage output at the first control node E1 is often slightly less than the first level signal. This means that for the pixel driving circuit shown in FIG. 1, in actual operations, the voltage at the first control node E1 is typically slightly less than or equal to the voltage at the third control node E3. That is, $V_{gs}$ is slightly less than or equal to 0. It can be seen that if the first transistor T1 in an ideal state (that is, a threshold voltage $V_{th}$ of the first transistor T1 is a negative value) is considered, generally, the first transistor T1 will not be turned on during the light-emitting stage because $V_{gs}\geq V_{th}$. However, due to process errors or temperature dependence, etc., in actual operations, the threshold voltage $V_{th}$ of the first transistor T1 may be offset from a negative value to a zero, or even to a positive value. In this case, if $V_{gs}$ is still slightly less than or equal to 0, $V_{gs}$ will be less than $V_{th}$ for the first transistor T1, that is, $V_{gs}<V_{th}$. This means that $V_{gs}$ will be less than the threshold voltage $V_{th}$ due to various practical factors, causing the first transistor to be conducting, thereby generating a leakage current. In such a case, the leakage current will rush into a second control node E2, causing voltage fluctuation at the second control node E2, and ultimately resulting in multi-line output at the pixel unit signal output node EO. This can for example cause problems such as display abnormality. In this regard, it will be apparent in conjunction with the circuit diagram in FIG. 1 and the timing diagram in FIG. 2.

Figure 3:
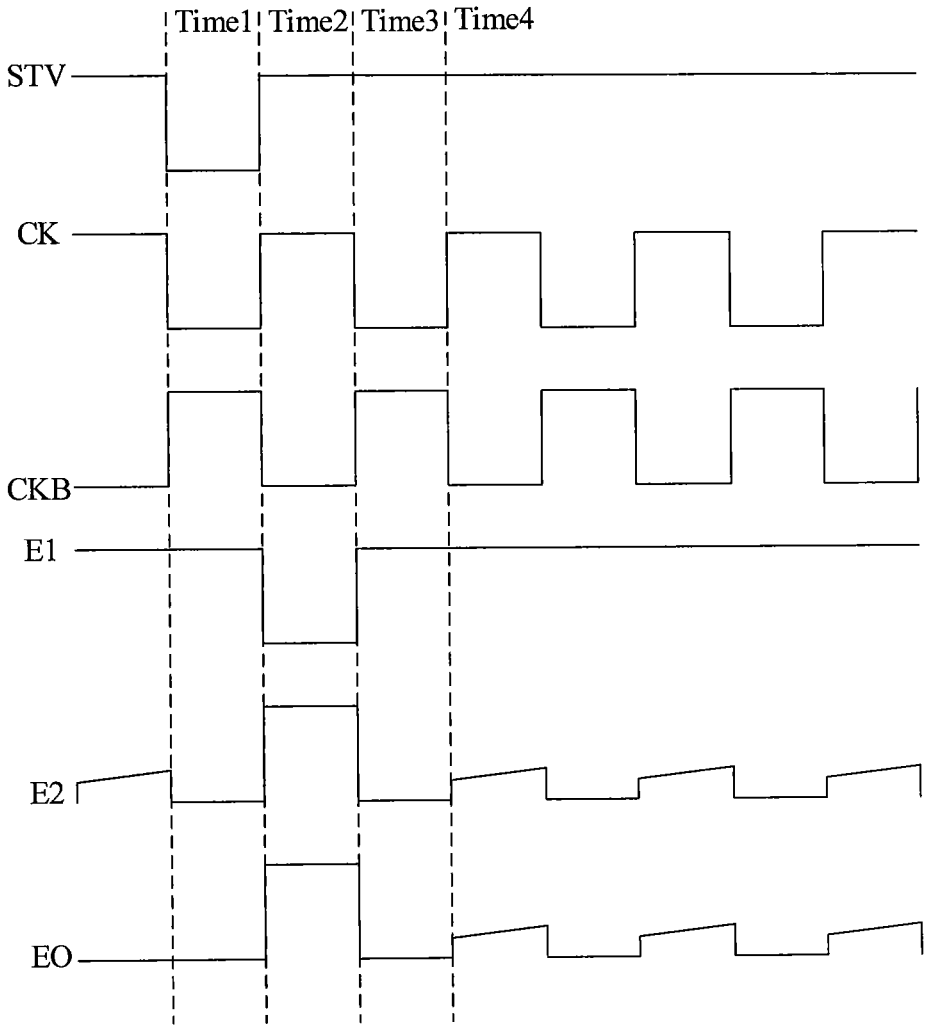
FIG. 3 is another timing diagram of operation of the pixel driving circuit shown in FIG. 1.

Furthermore, the inventors have also found that for the pixel driving circuit shown in FIG. 1, one plate of the first capacitor C1 is connected to the second control node E2, and the other plate is connected to the second clock signal input terminal CKB. During operation of the pixel driving circuit, as the operation stage changes, the second clock signal input terminal CKB converts the input second clock signal between a high level and a low level, thereby causing voltage fluctuation at the second control node E2. This will likely result in a high noise as output at the pixel unit signal output node EO, as shown in FIG. 3.

Figure 4:
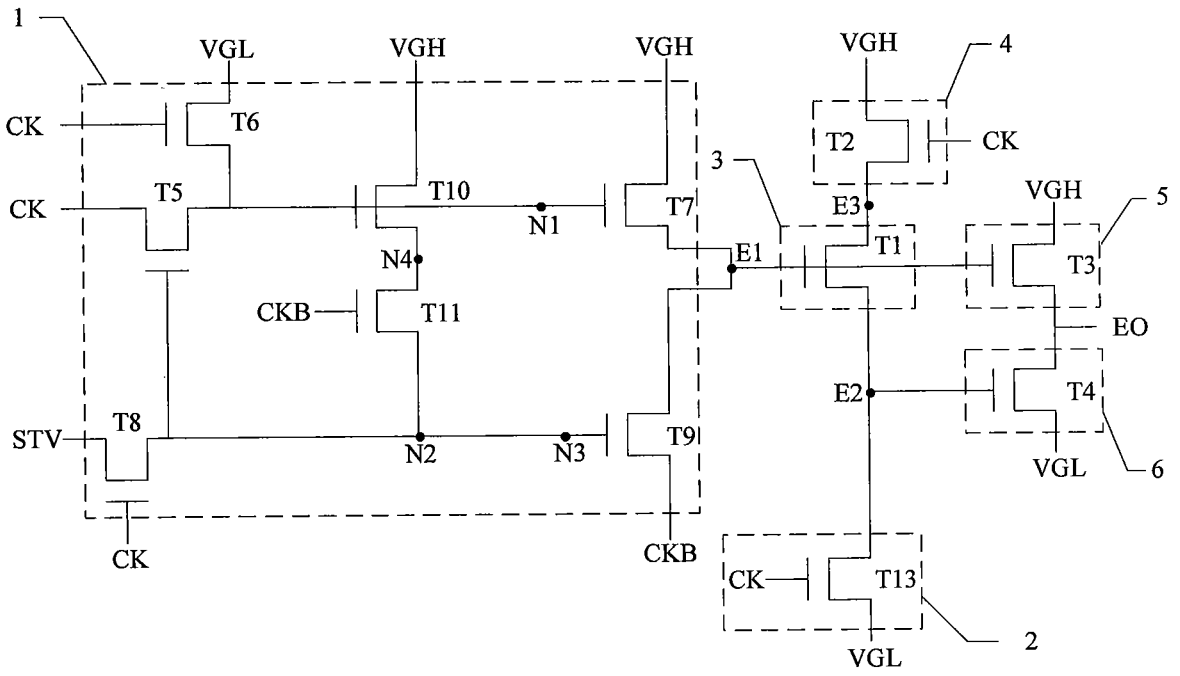
FIG. 4 is a schematic structural diagram of a pixel driving circuit according to an embodiment of the present disclosure.

In view of above, embodiments of the present disclosure propose a pixel driving circuit. The pixel driving circuit is configured to control on and off of a pixel unit. As shown in FIG. 4, the pixel driving circuit includes: a first control sub-circuit 1, a first output sub-circuit 5, a second control sub-circuit 2, a second output sub-circuit 6, a third control sub-circuit 3, and a fourth control sub-circuit 4.

Specifically, the first control sub-circuit 1 is connected to the first output sub-circuit 5 and the third control sub-circuit 3 respectively through a first control node E1. The first output sub-circuit 5 is further connected to a first level signal input terminal VGH and a pixel unit signal output node EO, respectively. The pixel unit signal output node EO is configured to control on and off of a pixel unit. The second control sub-circuit 2 is connected to the third control sub-circuit 3 and the second output sub-circuit 6 respectively through a second control node E2. The second output sub-circuit 6 is further connected to a second level signal input terminal VGL and the pixel unit signal output node EO, respectively. The third control sub-circuit 3 is further connected to the fourth control sub-circuit 4 through a third control node E3, and the fourth control sub-circuit 4 is further connected to the first level signal input terminal VGH and a first clock signal input terminal CK, respectively.

When the first control sub-circuit 1 outputs a first level signal to the first control node E1, the first output sub-circuit 5 is turned off and the second output sub-circuit 6 is turned on. Further, when a first clock signal input at the first clock signal input terminal CK is an on signal, the fourth control sub-circuit 4 is turned on. In such a case, the fourth control sub-circuit 4 will cause a voltage drop of the first level signal input at the first level signal input terminal VGH, and output the first level signal with the voltage drop to the third control node E3, such that a voltage at the first control node E1 is greater than or equal to a voltage at the third control node E3, thereby maintaining the third control sub-circuit 3 off. In this way, the leakage current generated by the third control sub-circuit 3 due to conduction is avoided.

Since the third control sub-circuit 3 maintains off, no leakage current will be output to the second control node E2, so that a voltage at the second control node E2 can be kept stable. In this way, potential fluctuation of the second level signal output from the second output sub-circuit 6 is avoided, and problems such as display abnormality due to multi-line output at the pixel unit signal output node EO are solved.

Figure 5:
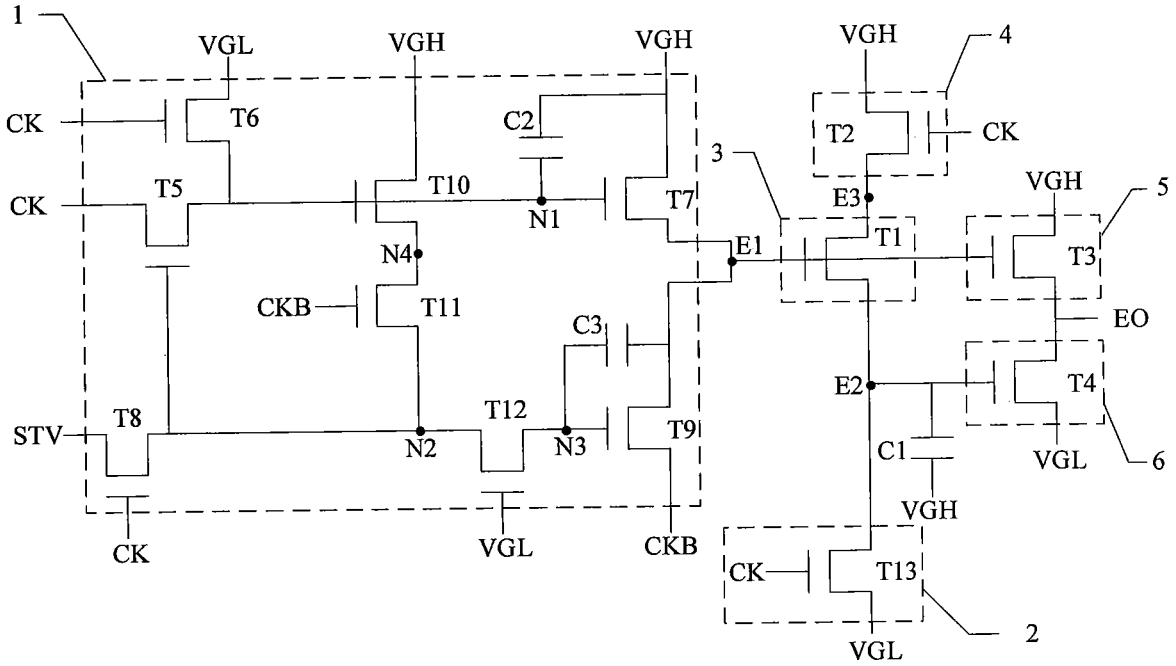
FIG. 5 is a schematic structural diagram of a pixel driving circuit according to another embodiment of the present disclosure.

In an alternative embodiment, as shown in FIG. 5, the pixel driving circuit further includes a first capacitor C1. One plate (e.g., the upper plate) of the first capacitor C1 is connected to the second control node E2, and the other plate (e.g., the lower plate) of the first capacitor C1 is connected to the first level signal input terminal VGH.

Since the lower plate of the first capacitor C1 is connected to the first level signal input terminal VGH, and a voltage of the first level signal input at the first level signal input terminal is constant, a voltage at the lower plate of the first capacitor C1 will not change with different stages of operation of the pixel driving circuit. In such a case, a voltage at the upper plate of the first capacitor C1 is also constant according to characteristics of the first capacitor C1. Thereby, the effect of stabilizing voltage at the second control node E2 is achieved, thereby avoiding further an abrupt change of voltage at the second control node E2. This facilitates further stabilization of voltage at the pixel unit signal output node EO, and avoids problems such as display abnormality caused by noise generated by the second level signal.

Specific structures of each sub-circuit will be further described below with reference to FIG. 4 and FIG. 5. Specifically, phases of the first level signal and the second level signal are different by 180°. Phases of the first clock signal and the second clock signal are different by 180°.

The first control sub-circuit 1 includes a fifth transistor T5, a sixth transistor T6, a seventh transistor T7, an eighth transistor T8, a ninth transistor T9, a tenth transistor T10, and an eleventh transistor T11.

A gate of the fifth transistor T5 is connected to a second node N2, a source of the fifth transistor T5 is connected to the first clock signal input terminal CK, and a drain of the fifth transistor T5 is connected to a first node N1, for outputting a first clock signal input at the first clock signal input terminal CK to the first node N1 when a signal at the second node N2 is an on signal.

A gate of the sixth transistor T6 is connected to the first clock signal input terminal CK, a source of the sixth transistor T6 is connected to the second level signal input terminal VGL, and a drain of the sixth transistor T6 is connected to the first node N1, for outputting a second level signal input at the second level signal input terminal VGL to the first node N1 when the first clock signal input at the first clock signal input terminal CK is an on signal.

A gate of the seventh transistor T7 is connected to the first node N1, a source of the seventh transistor T7 is connected to the first level signal input terminal VGH, and a drain of the seventh transistor T7 is connected to the first control node E1, for outputting the first level signal input at the first level signal input terminal VGH to the first control node E1 when a signal at the first node N1 is an on signal.

A gate of the eighth transistor T8 is connected to the first clock signal input terminal CK, a source of the eighth transistor T8 is connected to an initial signal input terminal STV, and a drain of the eighth transistor T8 is connected to the second node N2, for outputting an initial signal input at the initial signal input terminal STV to the second node N2 when the first clock signal input at the first clock signal input terminal CK is an on signal.

The second node N2 is connected to the third node N3.

A gate of the ninth transistor T9 is connected to the third node N3, a source of the ninth transistor T9 is connected to a second clock signal input terminal CKB, and a drain of the ninth transistor T9 is connected to the first control node E1, for outputting a second clock signal input at the second clock signal input terminal CKB to the first control node E1 when a signal at the third node N3 is an on signal.

A gate of the tenth transistor T10 is connected to the first node N1, a source of the tenth transistor T10 is connected to the first level signal input terminal VGH, and a drain of the tenth transistor T10 is connected to a fourth node N4, for outputting the first level signal input at the first level signal input terminal CK to the fourth node N4 when a signal at the first node N1 is an on signal.

A gate of the eleventh transistor T11 is connected to the second clock signal input terminal CKB, a source of the eleventh transistor T11 is connected to the fourth node N4, and a drain of the eleventh transistor T11 is connected to the second node N2, for outputting the first level signal input at the fourth node N4 to the second node N2 when the second clock signal input at the second clock signal input terminal CKB is an on signal.

In an alternative embodiment, as shown in FIG. 5, the first control sub-circuit further includes a twelfth transistor T12. A gate of the twelfth transistor T12 is connected to the second level signal input terminal VGL, a source of the twelfth transistor T1 is connected to the second node N2, and a drain of the twelfth transistor T12 is connected to the third node N3. Alternatively, a gate of the twelfth transistor T12 is connected to the second level signal input terminal VGL, a drain of the twelfth transistor T12 is connected to the second node N2, and a source of the twelfth transistor T12 is connected to the third node N3. The twelfth transistor T12 is configured to allow conduction between the second node N2 and the third node N3 when the second level signal input at the second level signal input terminal VGH is an on signal.

Since a voltage output to the third node N3 is unstable due to the leakage current as easily generated by the eighth transistor T8, the eighth transistor T8 is compensated by the twelfth transistor T12, and the voltage at the third node N3 can be stable.

In an alternative embodiment, as shown in FIG. 5, the first control sub-circuit 1 further includes a second capacitor C2 and/or a third capacitor C3. This means that the first control sub-circuit 1 can have both of the second capacitor C2 and the third capacitor C3, or only one of them.

Specifically, one plate of the second capacitor C2 (e.g., the lower plate) is connected to the first node N1, and the other plate of the second capacitor C2 (e.g., the upper plate) is connected to the first level signal input terminal VGH.

The second capacitor C2 has the function of storing energy, and it takes a certain time to charge and discharge. Therefore, when the upper plate of the second capacitor C2 is connected to the first level signal input terminal VGH, a voltage at the upper plate of the second capacitor C2 is stable. Further, given that the voltage across the second capacitor C2 will not change abruptly, a voltage at the lower plate of the second capacitor C2 is also stable. In this way, the second capacitor C2 can be made to stabilize the voltage at the first node N1, thereby avoiding an abrupt change in voltage at the first node N1. This facilitates the stabilization of voltage at the first control node E1, and avoids its influences on the operation of the pixel drive circuit.

One plate (e.g., the right plate) of the third capacitor C3 is connected to the first control node E1, and the other plate (e.g., the left plate) of the third capacitor C3 is connected to the third node N3.

The third capacitor C3 functions to lower the voltage at the second node N3, thereby further avoiding problems such as that voltage at the third node N3 affects the turn-on process of the ninth transistor T9 during operation of the pixel driving circuit. This allows the ninth transistor T9 to be fully turned on.

By means of the specific structure of the first control sub-circuit 1 described above, the voltage at the first control node E1 can be controlled during different stages of operation of the pixel drive circuit.

Specifically, the second control sub-circuit 2 includes a thirteenth transistor T13. A gate of the thirteenth transistor T13 is connected to the first clock signal input terminal CK, a source of the thirteenth transistor T13 is connected to the second level signal input terminal VGL, and a drain of the thirteenth transistor T13 is connected to the second control node E2.

The thirteenth transistor T13 is configured to output the second level signal input at the second level signal input terminal VGH to the second control Node E2 when the first clock signal input at the first clock signal input terminal CK is an on signal.

Specifically, the third control sub-circuit 3 includes a first transistor T1. A gate of the first transistor T1 is connected to the first control node E1, a source of the first transistor T1 is connected to the third control node E3, and a drain of the first transistor T1 is connected to the second control node E2.

Specifically, the fourth control sub-circuit 4 includes a second transistor T2. A gate of the second transistor T2 is connected to the first clock signal input terminal CK, a source of the second transistor T2 is connected to the first level signal input terminal VGH, and a drain of the second transistor T2 is connected to the third control node E3.

The second transistor T2 is configured to output the first level signal input at the first level signal input terminal VGH to the third control node E3 when the first clock signal input at the first clock signal input terminal CK is an on signal.

In the fourth control sub-circuit 4, with disposition of the second transistor T2, voltage at the third control node E3 can be controlled. Therefore, when it is needed to turn off the first transistor T1, leakage current due to conduction between the source and the drain of the first transistor T1 can be avoided.

Specifically, the first output sub-circuit 5 includes a third transistor T3. A gate of the third transistor T3 is connected to the first control node E1, a source of the third transistor T3 is connected to the first level signal input terminal VGH, and a drain of the third transistor T3 is connected to the pixel unit signal output node EO.

The second output sub-circuit 6 includes a fourth transistor T4. A gate of the fourth transistor T4 is connected to the second control node E2, a source of the fourth transistor T4 is connected to the second level signal input terminal VGL, and a drain of the fourth transistor T4 is connected to the pixel unit signal output node EO.

Further, the width-to-length ratio for channel of the third transistor T3 is larger than that of the fourth transistor T4.

In the first output sub-circuit 5, with the above-described structure design, it can be ensured that the first level signal is output to the pixel unit signal output node EO during operation of the pixel driving circuit. Correspondingly, in the second output sub-circuit 6, with the above structure design, it can be ensured that the second level signal is output to the pixel unit signal output node EO during operation of the pixel driving circuit. Further, by selecting the width-to-length ratio for channel of the third transistor T3 and the fourth transistor T4, the signal output from the third transistor T3 can be made dominant when the third transistor T3 and the fourth transistor T4 are turned on simultaneously.

Figure 6:
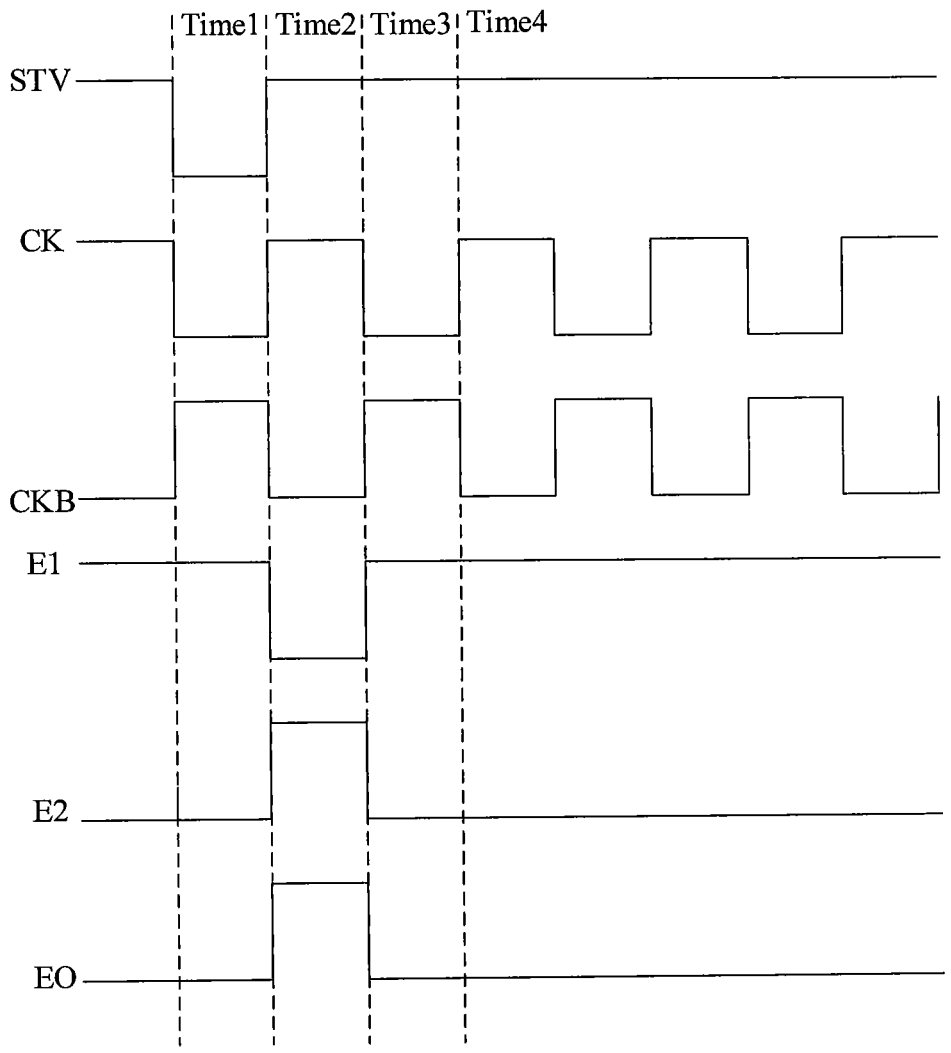
FIG. 6 is a timing diagram of operation of a pixel driving circuit according to an embodiment of the present disclosure.

Referring to FIG. 6, a timing diagram for operation of a pixel driving circuit according to an embodiment of the present disclosure is shown. The operation of the pixel driving circuit will be briefly described below by taking the pixel driving circuit shown in FIG. 5 as an example, and further combining the equivalent circuit diagrams of the pixel driving circuit during different stages shown in FIGS. 7-10. As an example, the transistors are all selected to be PMOS transistors, and the first level signal is a high level signal while the second level signal is a low level signal.

Figure 7:
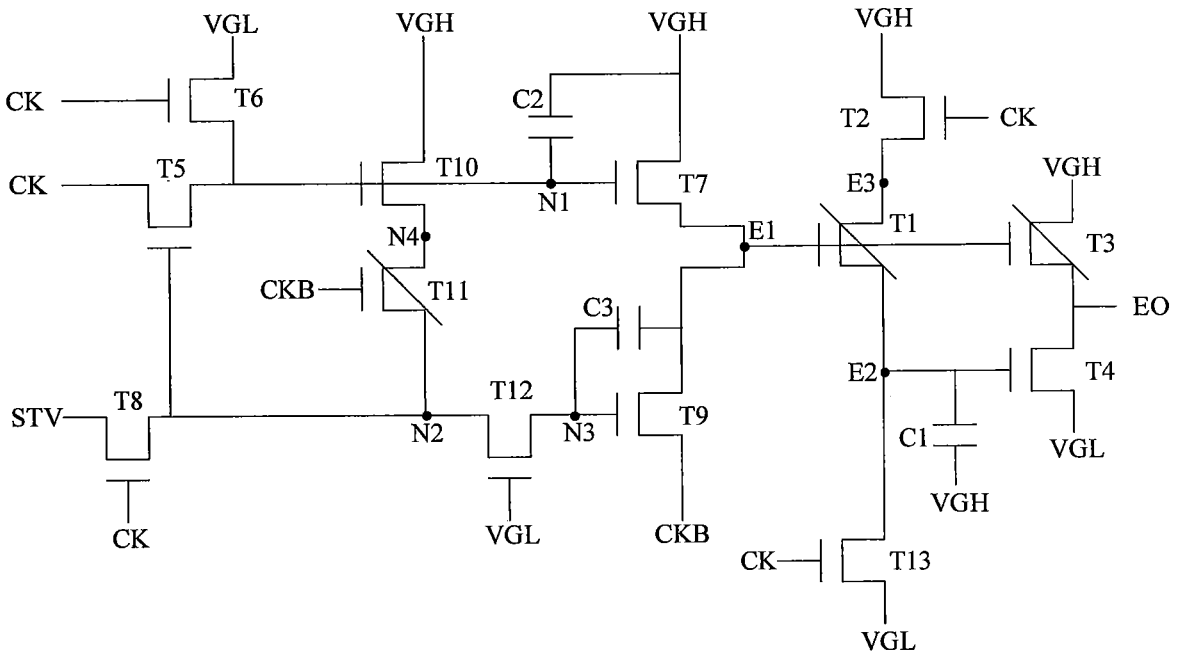
FIG. 7 is a schematic diagram of an equivalent circuit for a pixel driving circuit during a first stage, according to an embodiment of the present disclosure.

The first stage, Time1, is a reset stage, in which a signal in a previous frame is reset. It should be understood that if it is the first frame, there is no first stage Time1. During this stage, the first clock signal input at the first clock signal input terminal CK is at a low level, the initial signal input at the initial signal input terminal STV is at a low level, the second clock signal input at the second clock signal input terminal CKB is at a high level, the first level signal input at the first level signal input terminal VGH is at a high level, and the second level signal input at the second level signal input terminal VGL is at a low level. As shown in FIG. 7 (in which a slash symbol at a transistor indicates that the transistor is turned off), during the first stage Time1, low level signals are input at the first clock signal input terminal CK and the first level signal input terminal VGH, thus the sixth transistor T6, the eighth transistor T8, the second transistor T2, the thirteenth transistor T13, and the twelfth transistor T12 are turned on, while the eleventh transistor T11 is turned off. Further, the initial signal input terminal STV outputs an initial signal to the second node N2 through the conducting eighth transistor T8, thereby causing the fifth transistor T5 to be turned on. In a similar manner, the first clock signal input terminal CK outputs the first clock signal to the first node N1 through the conducting fifth transistor T5, and the second level signal input terminal VGL also outputs the second level signal to the first node N1 through the conducting sixth transistor T6, thereby causing the seventh transistor T7 to be turned on. Likewise, the initial signal is output from the second node N2 to the third node N3 through the conducting twelfth transistor T12, thereby causing the ninth transistor T9 to be turned on. Further, the first level signal input terminal VGH outputs the first level signal to the first control node E1 through the conducting seventh transistor T7, and the second clock signal input terminal CKB outputs the second clock signal to the first control node E1 through the conducting ninth transistor T9, thereby causing both the first transistor T1 and the third transistor T3 to be turned off. The second level signal input terminal VGL outputs the second level signal to the second control node E2 through the conducting thirteenth transistor T13, thereby causing the fourth transistor T4 to be turned on. The second level signal input terminal VGL outputs the second level signal to the pixel unit signal output node EO through the conducting fourth transistor T4, thereby resetting the voltage. It should be understood that in the first stage Time1, both the second transistor T2 and the tenth transistor T10 are turned on, but this does not affect the operation of the entire circuit.

Figure 8:
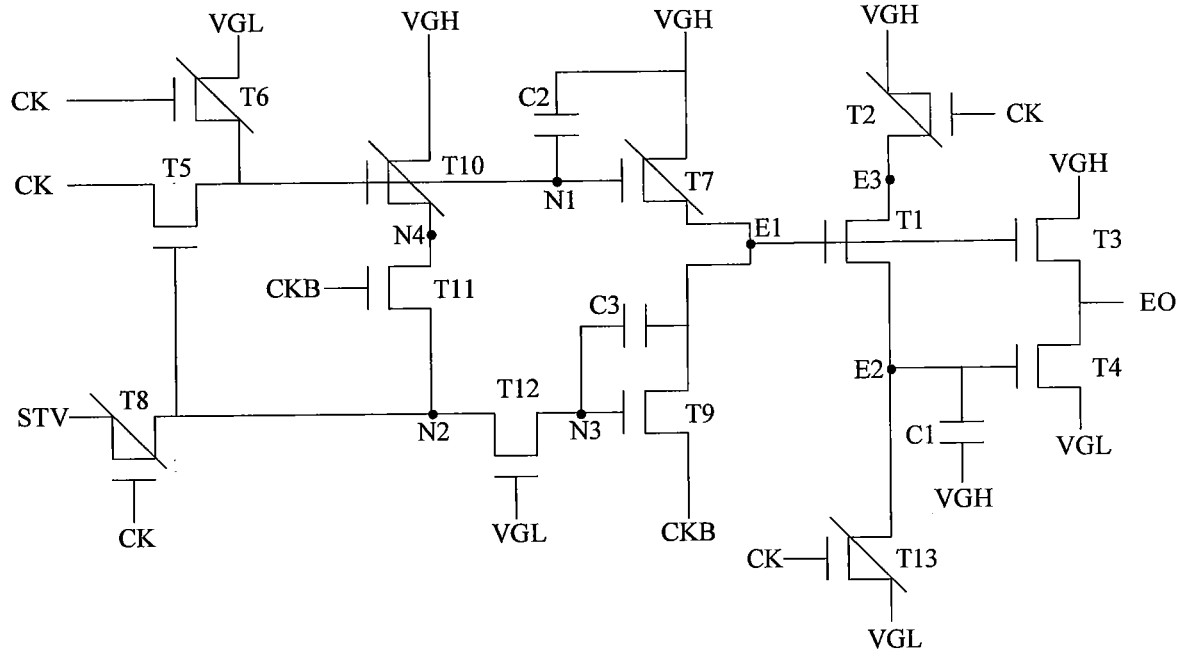
FIG. 8 is a schematic diagram of an equivalent circuit for a pixel driving circuit during a second stage, according to an embodiment of the present disclosure.

During the second stage Time2, the light emitting device D does not emit light. In this stage, the first clock signal input at the first clock signal input terminal CK is at a high level, the second clock signal input at the second clock signal input terminal CKB is at a low level, the first level signal input at the first level signal input terminal VGH is at a high level, and the second level signal input at the second level signal input terminal VGL is at a low level. As shown in FIG. 8 (in which a slash symbol at a transistor indicates that the transistor is turned off), during the second stage Time2, the sixth transistor T6, the eighth transistor T8, the second transistor T2, and the thirteenth transistor T13 are turned off, while the twelfth transistor T12 is turned on. At this point, the second node N2 maintains the signal potential (i.e., the low level) in the first stage Time1, thereby causing the fifth transistor T5 to be turned on. The first clock signal input terminal CK outputs the first clock signal to the first node N1 through the conducting fifth transistor T5, thereby causing the seventh transistor T7 to be turned off. Since the twelfth transistor T12 is turned on, like the second node N2, the third node N3 also maintains the signal potential (i.e., the low level) in the first stage Time1, thereby causing the ninth transistor T9 to be turned on. The second clock signal input terminal CKB outputs the second clock signal to the first control node E1 through the conducting ninth transistor T9. Since the second clock signal changes from the high level in the first stage Time1 to the low level, voltage at the right plate of the third capacitor C3 (i.e., voltage corresponding to the first control node E1) decreases. At this point, under the effect of third capacitor C3, voltage at the left plate of the third capacitor C3 also decreases, thereby reducing further the voltage at the third node N3. During the second stage Time2, it is ensured that the ninth transistor T9 remains on. The low-level signal at the first control node E1 drives the first transistor T1 and the third transistor T3 to be turned on. The first level signal input terminal VGH outputs the first level signal to the pixel unit signal output node EO through the conducting third transistor T3. The second control node E2 maintains the signal potential (i.e., the low level) in the first stage Time1, thereby causing the fourth transistor T4 to be turned on. The second level signal input terminal VGL outputs the second level signal to the pixel unit signal output node EO through the conducting fourth transistor T4. Since the width-to-length ratio for channel of the third transistor T3 is larger than that of the fourth transistor T4, the first level signal output from the third transistor T3 will be dominant. Therefore, the high level signal output from the pixel unit signal output node EO to the pixel unit is dominant, so that the pixel unit remains off and does not emit light. It should be understood that in the second stage Time2, the eleventh transistor T11 is turned on, but this does not affect the operation of the entire circuit.

Figure 9:
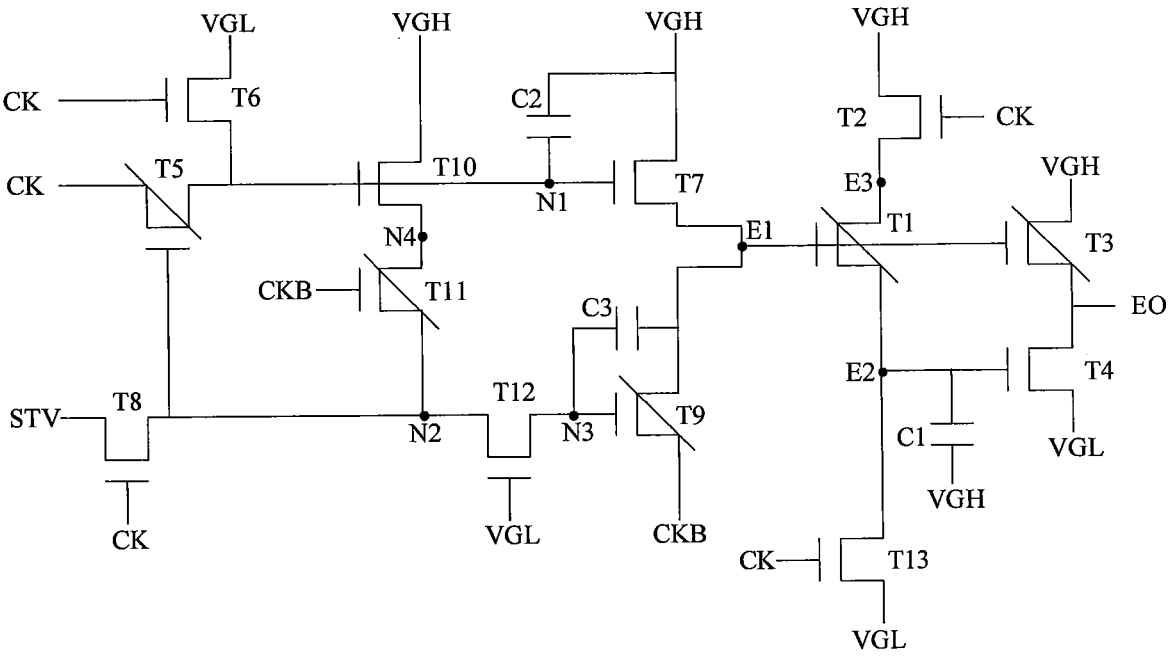
FIG. 9 is a schematic diagram of an equivalent circuit for a pixel driving circuit during a third stage, according to an embodiment of the present disclosure.

The third stage Time3 is a light-emitting stage in which the light-emitting device D emits light. During this stage, the first clock signal input at the first clock signal input terminal CK is at a low level, the initial signal input at the initial signal input terminal STV is at a high level, the second clock signal input at the second clock signal input terminal CKB is at a high level, the first level signal input at the first level signal input terminal VGH is at a high level, and the second level input at the second level signal input terminal VGL is at a low level. As shown in FIG. 9 (in which a slash symbol at a transistor indicates that the transistor is turned off), the sixth transistor T6, the eighth transistor T8, the second transistor T2, the thirteenth transistor T13, and the twelfth transistor T12 are turned on, while the eleventh transistor T11 is turned off. The initial signal input terminal STV outputs the initial signal to the second node N2 through the conducting eighth transistor T8, thereby causing the fifth transistor T5 to be turned off. The second level signal input terminal VGH outputs the second level signal to the first node N1 through the conducting sixth transistor T6, thereby causing the seventh transistor T7 to be turned on. Likewise, the initial signal is output from the second node N2 to the third node N3 through the conducting twelfth transistor T12, and the ninth transistor T9 is turned off under the control of a high level signal at the third node N3. The first level signal input terminal VGH outputs the first level signal to the first control node E1 through the conducting seventh transistor T7, thereby causing both of the first transistor T1 and the third transistor T3 to be turned off. The second level signal input terminal VGL outputs the second level signal to the second control node E2 through the conducting thirteenth transistor T13, thereby causing the fourth transistor T4 to be turned on. The second level signal input terminal VGL outputs the second level signal to the pixel unit signal output node EO through the conducting fourth transistor T4 such that the pixel unit is turned on to emit light. It should be understood that in the third stage Time3, the tenth transistor T10 is turned on, but this does not affect the operation of the entire circuit.

Figure 10:
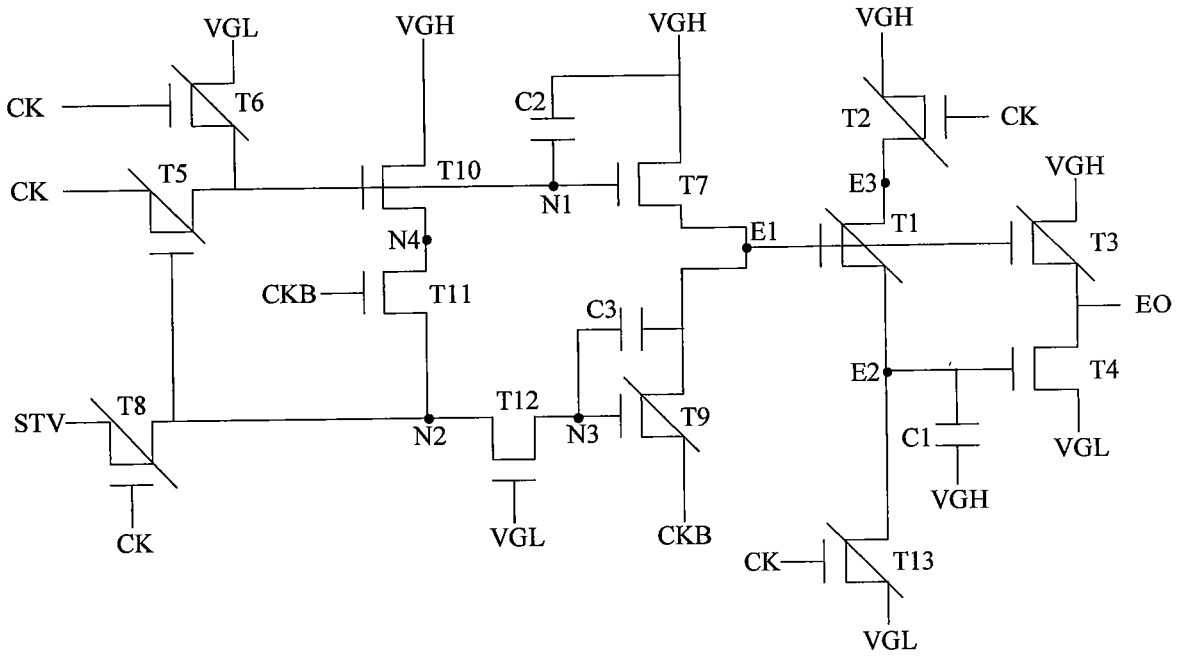
FIG. 10 is a schematic diagram of an equivalent circuit for a pixel driving circuit during a fourth stage, according to an embodiment of the present disclosure.

The fourth stage Time4 is an additional light-emitting stage in which the light emitting device D emits light. During this stage, the first clock signal input at the first clock signal input terminal CK is at a high level, the initial signal input at the initial signal input terminal STV is at a high level, the second clock signal input at the second clock signal input terminal CKB is at a low level, the first level signal input at the first level signal input terminal VGH is at a high level, and the second level signal input at the second level signal input terminal VGL is at a low level. As shown in FIG. 10 (in which a slash symbol at a transistor indicates that the transistor is turned off), the second transistor T2, the sixth transistor T6, the eighth transistor T8, and the thirteenth transistor T13 are turned off, while the eleventh transistor T11 and the twelfth transistor T12 are turned on. At this point, the first node N1 maintains the signal potential (i.e., the low level) in the third stage Time3, thereby causing the seventh transistor T7 and the tenth transistor T10 to be turned on. The first level signal input terminal VGH outputs the first level signal (i.e., the high level) to the second node N2 through the conducting tenth and eleventh transistors T10, T11, thereby causing the fifth transistor T5 to be turned off. The first level signal is output from the second node N2 to the third node N3 through the conducting twelfth transistor T12, thereby causing the ninth transistor T9 to be turned off. The first level signal input terminal VGH outputs the first level signal to the first control node E1 through the conducting seventh transistor T7, thereby causing both of the first transistor T1 and the third transistor T3 to be turned off. At this point, the second control node E2 maintains the signal potential (i.e., the low level) in the third stage Time3, thereby causing the fourth transistor T4 to be turned on. The second level signal input terminal VGL outputs the second level signal to the pixel unit signal output node EO through the conducting fourth transistor T4 such that the pixel unit is turned on to emit light.

In particular, when the threshold voltage of the first transistor T1 is shifted from a negative value to zero or even to a positive value due to process errors or temperature dependence, there may be conduction between the source and the drain of the first transistor T1. Thus, leakage current is generated, and light emissions in the third stage Time3 and the fourth stage Time4 are affected.

In view of above, in order to prevent leakage current from being generated by the first transistor T1, the second transistor T2 is disposed. In the third stage Time3, since the second transistor T2 is turned on, the first level signal input terminal VGH outputs the first level signal to the third control node E3 through the conducting second transistor T2. In practical applications, since the second transistor T2 has a certain resistance, the potential of the second level signal will decrease after it passes through the second transistor T2. During the subsequent fourth stage Time4, since the second transistor T2 is turned off, the voltage at the third control node E3 maintains the signal level in the third stage Time3. In this case, since the second level signal is simultaneously output to the first control node E1 and the third control node E3, and the second transistor T2 exhibits a level lowering effect on the second level signal, the voltage at the first control node E1 is higher than or equal to the voltage at the third control node E3 (at this point, since the seventh transistor T7 may also cause a voltage drop of the signal, an equal condition may occur). In this way, the gate voltage of the first transistor T1 will be higher than or equal to the voltage at the source, thereby avoiding the occurrence of $V_{gs}<V_{th}$ for the first transistor due to the threshold voltage of the first transistor T1 shifting from a negative value to zero or even to a positive value. Thus, erroneous turning on of the first transistor T1 is avoided, thereby eliminating the leakage current generated from the first transistor T1. Furthermore, since the voltage at the second control node E2 is not affected, the output from the fourth transistor T4 is relatively stable. Finally, during the third stage Time3 and the fourth stage Time4 (i.e., the light-emitting stage), a clean pulse signal can be output from the pixel unit signal output node EO, as shown in FIG. 5.

In summary, embodiments of the present disclosure provide a pixel driving circuit, in which a fourth control sub-circuit 4 connected to a third control sub-circuit 3 is disposed. When a first level signal is outputted by a first control sub-circuit 1 to the first control node E1, the fourth control sub-circuit 4 is turned on. At the same time, a voltage of the first level signal input to the fourth control sub-circuit 4 is lowered by the fourth control sub-circuit 4, and the first level signal after the voltage is lowered is output to the third control node E3, thereby ensuring that a voltage at the first control node E1 is greater than or equal to a voltage at the third control node E3. In this way, leakage current due to the third control sub-circuit 3 being conductive is avoided, so that the third control sub-circuit 3 can be kept turned off. Therefore, no leakage current is output to the second control node E2, thereby ensuring that a voltage at the second control node E2 is stable, and avoiding potential fluctuation of the second level signal output from the second output sub-circuit 6. Finally, problems such as display abnormality due to multi-line output of the pixel unit signal output node EO are solved. Further, by connecting one plate of the first capacitor C1 to the first level signal input terminal VGH, in a case where the voltage of the first level signal input at the first level signal input terminal keeps constant, a voltage at this plate of the first capacitor C1 will not change during different stages of operation of the pixel drive circuit. Thus, according to characteristics of the first capacitor C1, voltage at the other plate of the first capacitor C1 will also be constant, thereby stabilizing the voltage at the second control node E2. This avoids further an abrupt change of the voltage at the second control node E2, thereby facilitating further stabilization of the voltage at the pixel unit signal output node EO, and avoiding problems such as display abnormality caused by noise generated by the second level signal.

Embodiments of the present disclosure also provide a display device. For example, the display device can be an AMOLED display device. The display device includes the pixel driving circuit as described in any of the above embodiments. The display device shows the same advantageous effects as the pixel driving circuit provided in any of the above embodiments of the present disclosure. Since the pixel driving circuit has been described in detail in the above embodiments, the description of the display device will not be repeated here.

Embodiments of the present disclosure also provide a driving method. The driving method is for driving on and off of the pixel unit using the pixel driving circuit as described in any of the above embodiments. When compared with a conventional scheme, during light-emitting stages (corresponding to the third stage Time3 and the fourth stage Time4 in the above embodiments), the driving method can cause a voltage drop of the first level signal input to the fourth control sub-circuit 4 by the fourth control sub-circuit 4, and then the first level signal after the voltage is lowered is output to the third control node E3. In this way, the voltage at the third control node E3 is made smaller than the voltage at the first control node E1, thereby maintaining the first transistor T1 off and avoiding leakage current.

Specifically, the driving method includes: during a light-emitting stage, driving the second output sub-circuit 6 to be turned on, wherein the second output sub-circuit 6 output the second level signal input at the second level signal input terminal VGL to the pixel unit signal output node EO; driving the first control sub-circuit 1 to output the first level signal to the first control node E1, thereby controlling the third control sub-circuit 3 and the first output sub-circuit 5 to be turned off; and driving the fourth control sub-circuit 4 to be turned on, wherein the fourth control sub-circuit 4 causes a voltage drop of the first level signal received from the first level signal input terminal, and outputs the first level signal with the voltage drop to the third control node E3, such that a voltage at the first control node E1 is larger than or equal to a voltage at the third control node E3, thereby maintaining the third control sub-circuit off.

Therefore, during the light-emitting stage, the first transistor T1 does not generate a leakage current, and the second control node E2 is not affected by the leakage current, thereby ensuring that the voltage at the second control node E2 remains stable. In this way, fluctuations in the second level signal output from the second output sub-circuit 6 are avoided, thereby solving problems such as display abnormality due to multi-line output of the pixel unit signal output node EO.

It should be understood that if the driving method is applied in the first frame of the pixel driving circuit, the driving method may further include the step of controlling the pixel unit to be turned off. Specifically, according to the timing of operation, there are three steps which are corresponding respectively to the second stage Time2 to the fourth stage Time4 in the foregoing embodiment, and are not described herein again.

If the driving method is applied in each frame after the first frame of the pixel driving circuit, the driving method may further include steps of controlling the pixel unit to be reset and controlling the pixel unit to be turned off. Specifically, according to the timing of operation, there are four steps which are corresponding respectively to the first stage Time1 to the fourth stage Time4 in the foregoing embodiment, and are not described herein again.

In summary, in the driving method as proposed by embodiments of the present disclosure, during the light-emitting stage, the voltage at the first control node E1 is made greater than or equal to the voltage at the third control node E3 by means of the third control sub-circuit 3. Thereby, it is ensured that the first transistor T1 does not generate leakage current, thereby preventing the second control node E2 from being affected by the leakage current, and finally maintaining the voltage at the second control node E2 stable. This will help avoiding fluctuations in the second level signal output from the second output sub-circuit 6, thereby solving problems such as display abnormality due to multi-line output of the pixel unit signal output node EO.

Various embodiments in the specification have been described in a progressive manner, and each embodiment focuses on their differences from other embodiments. Therefore, for the same or similar parts between the various embodiments, mutual reference is sufficient.

While advantageous embodiments of the present disclosure have been described, those skilled in the art can make additional variations and modifications to these embodiments under teachings of the basic inventive concept. Therefore, the appended claims are intended to be interpreted as including all the embodiments as well as all the variations and modifications that fall in the scope of the embodiments.

Finally, it should also be noted that in this context, relational terms such as first and second are used merely to distinguish one entity or operation from another entity or operation, and do not necessarily require or imply that these entities or operations have any of such an actual relationship or order. Furthermore, the terms such as "comprise," "include," or any other variant thereof are not exclusive. Therefore, a process, method, article, or terminal device including several elements include not only these elements, but also other elements that are not explicitly listed, or include elements as inherent to such a process, method, article, or terminal device. An element defined by the phrase of "comprising one . . . " does not exclude the presence of other same elements in the process, method, article, or terminal device including the element.

The above embodiments are only used for explanations rather than limitations to the present disclosure. The ordinary skilled person in the related technical field, in the case of not departing from the spirit and scope of the present disclosure, may also make various modifications and variations. Therefore, all the equivalent solutions also belong to the scope of the present disclosure, and the patent protection scope of the present disclosure should be defined by the claims.

The invention claimed is:

1. A pixel driving circuit configured to control a pixel unit, the pixel driving circuit comprising:

a first control sub-circuit, a first output sub-circuit, a second control sub-circuit, a second output sub-circuit, a third control sub-circuit, and a fourth control sub-circuit, wherein the first control sub-circuit is connected to the first output sub-circuit and the third control sub-circuit through a first control node, wherein the first output sub-circuit is connected to a first level signal input terminal and a pixel unit signal output node, wherein the pixel unit signal output node is configured to control the pixel unit, wherein the second control sub-circuit is connected to the third control sub-circuit and the second output sub-circuit through a second control node, wherein the second output sub-circuit is connected to a second level signal input terminal and the pixel unit signal output node, wherein the third control sub-circuit is connected to the fourth control sub-circuit through a third control node, wherein the fourth control sub-circuit is connected to the first level signal input terminal and a first clock signal input terminal, and wherein the fourth control sub-circuit is configured, when turned on, to cause a voltage drop of a first level signal that is input at the first level signal input terminal, and to output the first level signal with the voltage drop to the third control node, such that a voltage at the third control node is less than or equal to a voltage at the first control node, thereby maintaining the third control sub-circuit in an off state.

2. The pixel driving circuit according to claim 1, wherein the third control sub-circuit comprises a first transistor, wherein a gate of the first transistor is connected to the first control node, a source of the first transistor is connected to the third control node, and a drain of the first transistor is connected to the second control node, and wherein the fourth control sub-circuit comprises a second transistor, wherein a gate of the second transistor is connected to the first clock signal input terminal, a source of the second transistor is connected to the first level signal input terminal, and a drain of the second transistor is connected to the third control node.

3. The pixel driving circuit according to claim 1, further comprising:

a first capacitor, wherein a first plate of the first capacitor is connected to the second control node, and a second plate of the first capacitor is connected to the first level signal input terminal.

4. The pixel driving circuit according to claim 1, wherein the first output sub-circuit comprises a third transistor, wherein a gate of the third transistor is connected to the first control node, a source of the third transistor is connected to the first level signal input terminal, and a drain of the third transistor is connected to the pixel unit signal output node, wherein the second output sub-circuit comprises a fourth transistor, wherein a gate of the fourth transistor is connected to the second control node, a source of the fourth transistor is connected to the second level signal input terminal, and a drain of the fourth transistor is connected to the pixel unit signal output node, and wherein a width-to-length ratio of the third transistor is larger than a width-to-length ratio of the fourth transistor.

5. The pixel driving circuit according to claim 1, wherein the first control sub-circuit comprises:

a fifth transistor, a sixth transistor, a seventh transistor, an eighth transistor, a ninth transistor, a tenth transistor, and an eleventh transistor, wherein a gate of the fifth transistor is connected to a second node, a source of the fifth transistor is connected to the first clock signal input terminal, and a drain of the fifth transistor is connected to a first node, wherein the fifth transistor is configured to output a first clock signal that is input at the first clock signal input terminal to the first node when switched on responsive to a signal at the second node, wherein a gate of the sixth transistor is connected to the first clock signal input terminal, a source of the sixth transistor is connected to the second level signal input terminal, and a drain of the sixth transistor is connected to the first node, wherein the sixth transistor is configured to output a second level signal that is input at the second level signal input terminal to the first node when switched on responsive to the first clock signal that is input at the first clock signal input terminal, wherein a gate of the seventh transistor is connected to the first node, a source of the seventh transistor is connected to the first level signal input terminal, and a drain of the seventh transistor is connected to the first control node, wherein the seventh transistor is configured to output the first level signal that is input at the first level signal input terminal to the first control node when switched on responsive to a signal at the first node, wherein a gate of the eighth transistor is connected to the first clock signal input terminal, a source of the eighth transistor is connected to an initial signal input terminal, and a drain of the eighth transistor is connected to the second node, wherein the eighth transistor is configured to output an initial signal that is input at the initial signal input terminal to the second node when switched on responsive to the first clock signal that is input at the first clock signal input terminal, wherein the second node is connected to a third node, wherein a gate of the ninth transistor is connected to the third node, a source of the ninth transistor is connected to a second clock signal input terminal, and a drain of the ninth transistor is connected to the first control node, wherein the ninth transistor is configured to output a second clock signal that is input at the second clock signal input terminal to the first control node when switched on responsive to a signal at the third node, wherein a gate of the tenth transistor is connected to the first node, a source of the tenth transistor is connected to the first level signal input terminal, and a drain of the tenth transistor is connected to a fourth node, wherein the tenth transistor is configured to output the first level signal that is input at the first level signal input terminal to the fourth node when switched on responsive to a signal at the first node, and wherein a gate of the eleventh transistor is connected to the second clock signal input terminal, a source of the eleventh transistor is connected to the fourth node, and a drain of the eleventh transistor is connected to the second node, wherein the eleventh transistor is configured to output a signal input at the fourth node to the second node when switched on responsive to the second clock signal that is input at the second clock signal input terminal.

6. The pixel driving circuit according to claim 5, wherein the first control sub-circuit further comprises a twelfth transistor, a gate of the twelfth transistor is connected to the second level signal input terminal, a source of the twelfth transistor is connected to the second node, and a drain of the twelfth transistor is connected to the third node, wherein the twelfth transistor is configured to conduct between the second node and the third node when switched on responsive to a signal that is input at the second level signal input terminal.

7. The pixel driving circuit according to claim 5, wherein the first control sub-circuit further comprises a twelfth transistor, a gate of the twelfth transistor is connected to the second level signal input terminal, a drain of the twelfth transistor is connected to the second node, and a source of the twelfth transistor is connected to the third node, wherein the twelfth transistor is configured to conduct between the second node and the third node when switched on responsive to the second level signal that is input at the second level signal input terminal.

8. The pixel driving circuit according to claim 5, wherein the first control sub-circuit further comprises at least one of a second capacitor and a third capacitor, wherein a first plate of the second capacitor is connected to the first node, and a second plate of the second capacitor is connected to the first level signal input terminal, and wherein a first plate of the third capacitor is connected to the first control node, and a second plate of the third capacitor is connected to the third node.

9. The pixel driving circuit according to claim 1, wherein the second control sub-circuit comprises a thirteenth transistor, a gate of the thirteenth transistor is connected to the first clock signal input terminal, a source of the thirteenth transistor is connected to the second level signal input terminal, and a drain of the thirteenth transistor is connected to the second control node, wherein the thirteenth transistor is configured to output the second level signal that is input at the second level signal input terminal to the second control node when switched on responsive to the first clock signal that is input at the first clock signal input terminal.

10. A display device, comprising the pixel driving circuit according to claim 1.

11. The display device according to claim 10, wherein the third control sub-circuit comprises a first transistor, a gate of the first transistor is connected to the first control node, a source of the first transistor is connected to the third control node, and a drain of the first transistor is connected to the second control node, and wherein the fourth control sub-circuit comprises a second transistor, a gate of the second transistor is connected to the first clock signal input terminal, a source of the second transistor is connected to the first level signal input terminal, and a drain of the second transistor is connected to the third control node.

12. The display device according to claim 10, wherein the pixel driving circuit further comprises:

a first capacitor, wherein a first plate of the first capacitor is connected to the second control node, and a second plate of the first capacitor is connected to the first level signal input terminal.

13. The display device according to claim 10, wherein the first output sub-circuit comprises a third transistor, a gate of the third transistor is connected to the first control node, a source of the third transistor is connected to the first level signal input terminal, and a drain of the third transistor is connected to the pixel unit signal output node, wherein the second output sub-circuit comprises a fourth transistor, a gate of the fourth transistor is connected to the second control node, a source of the fourth transistor is connected to the second level signal input terminal, and a drain of the fourth transistor is connected to the pixel unit signal output node, and wherein a width-to-length ratio of the third transistor is larger than a width-to-length ratio of the fourth transistor.

14. The display device according to claim 10, wherein the first control sub-circuit comprises: a fifth transistor, a sixth transistor, a seventh transistor, an eighth transistor, a ninth transistor, a tenth transistor, and an eleventh transistor, wherein a gate of the fifth transistor is connected to a second node, a source of the fifth transistor is connected to the first clock signal input terminal, and a drain of the fifth transistor is connected to a first node, wherein the fifth transistor is configured to output a first clock signal that isinput at the first clock signal input terminal to the first node when switched on responsive to a signal at the second node, wherein a gate of the sixth transistor is connected to the first clock signal input terminal, a source of the sixth transistor is connected to the second level signal input terminal, and a drain of the sixth transistor is connected to the first node, wherein the sixth transistor is configured to output a second level signal that isinput at the second level signal input terminal to the first node when switched on responsive to the first clock signal input at the first clock signal input terminal, wherein a gate of the seventh transistor is connected to the first node, a source of the seventh transistor is connected to the first level signal input terminal, and a drain of the seventh transistor is connected to the first control node, wherein the seventh transistor is configured to output the first level signal that is input at the first level signal input terminal to the first control node when switched on responsive to a signal at the first node, wherein a gate of the eighth transistor is connected to the first clock signal input terminal, a source of the eighth transistor is connected to an initial signal input terminal, and a drain of the eighth transistor is connected to the second node, wherein the eighth transistor is configured to output an initial signal that is input at the initial signal input terminal to the second node when switched on responsive to the first clock signal that is input at the first clock signal input terminal, wherein the second node is connected to a third node, wherein a gate of the ninth transistor is connected to the third node, a source of the ninth transistor is connected to a second clock signal input terminal, and a drain of the ninth transistor is connected to the first control node, wherein the ninth transistor is configured to output a second clock signal that is input at the second clock signal input terminal to the first control node when switched on response to a signal at the third node, wherein a gate of the tenth transistor is connected to the first node, a source of the tenth transistor is connected to the first level signal input terminal, and a drain of the tenth transistor is connected to a fourth node, wherein the tenth transistor is configured to output the first level signal that is input at the first level signal input terminal to the fourth node when switched on responsive to a signal at the first node, and wherein a gate of the eleventh transistor is connected to the second clock signal input terminal, a source of the eleventh transistor is connected to the fourth node, and a drain of the eleventh transistor is connected to the second node, wherein the eleventh transistor is configured to output a signal that is input at the fourth node to the second node when switched on responsive to the second clock signal that is input at the second clock signal input terminal.

15. The display device according to claim 14, wherein the first control sub-circuit further comprises a twelfth transistor, a gate of the twelfth transistor is connected to the second level signal input terminal, a source of the twelfth transistor is connected to the second node, and a drain of the twelfth transistor is connected to the third node, and wherein the twelfth transistor is configured to conduct between the second node and the third node when switched on responsive to a signal that is input at the second level signal input terminal.

16. The display device according to claim 14, wherein the first control sub-circuit further comprises a twelfth transistor, a gate of the twelfth transistor is connected to the second level signal input terminal, a drain of the twelfth transistor is connected to the second node, and a source of the twelfth transistor is connected to the third node, and wherein the twelfth transistor is configured to conduct between the second node and the third node when switched on responsive to the second level signal that is input at the second level signal input terminal.

17. The display device according to claim 14, wherein the first control sub-circuit further comprises at least one of a second capacitor and a third capacitor, wherein one plate of the second capacitor is connected to the first node, and the other plate of the second capacitor is connected to the first level signal input terminal, and wherein a first plate of the third capacitor is connected to the first control node, and a second plate of the third capacitor is connected to the third node.

18. The display device according to claim 10, wherein the second control sub-circuit comprises a thirteenth transistor, a gate of the thirteenth transistor is connected to the first clock signal input terminal, a source of the thirteenth transistor is connected to the second level signal input terminal, and a drain of the thirteenth transistor is connected to the second control node, wherein the thirteenth transistor is configured to output the second level signal that is input at the second level signal input terminal to the second control node when switched on responsive to the first clock signal that is input at the first clock signal input terminal.

19. A driving method for driving a pixel unit using the pixel driving circuit according to claim 1, the driving method comprising:

during a light-emitting stage, performing operations comprising:

driving the second output sub-circuit to be turned on, wherein the second output sub-circuit output the second level signal that is input at the second level signal input terminal to the pixel unit signal output node;

driving the first control sub-circuit to output the first level signal to the first control node, thereby controlling the third control sub-circuit and the first output sub-circuit to be turned off; and driving the fourth control sub-circuit to be turned on, wherein the fourth control sub-circuit causes a voltage drop of a first level signal received from the first level signal input terminal, and outputs the first level signal with the voltage drop to the third control node, such that a voltage at the third control node is less than or equal to a voltage at the first control node, thereby maintaining the third control sub-circuit off.

* * * * *